US012161152B2

(12) United States Patent
Mair et al.

(10) Patent No.: US 12,161,152 B2
(45) Date of Patent: Dec. 10, 2024

(54) AEROSOL-GENERATING ARTICLE HAVING RIGID ENVELOPING MATERIAL

(71) Applicant: DELFORTGROUP AG, Traun (AT)

(72) Inventors: Christian Mair, Innsbruck (AT); Dietmar Volgger, Gnadenwald (AT)

(73) Assignee: DELFORTGROUP AG, Traun (AT)

( * ) Notice: Subject to any disclaimer, the term of this patent is extended or adjusted under 35 U.S.C. 154(b) by 1112 days.

(21) Appl. No.: 16/975,457

(22) PCT Filed: Feb. 21, 2019

(86) PCT No.: PCT/EP2019/054262
§ 371 (c)(1),
(2) Date: Aug. 25, 2020

(87) PCT Pub. No.: WO2019/166308
PCT Pub. Date: Sep. 6, 2019

(65) Prior Publication Data

US 2021/0015147 A1 Jan. 21, 2021

(30) Foreign Application Priority Data

Mar. 2, 2018 (DE) ..... 10 2018 104 823.8

(51) Int. Cl.

| | |
|---|---|
| ***A24D 1/02*** | (2006.01) |
| ***A24C 5/01*** | (2020.01) |
| ***D21H 19/34*** | (2006.01) |
| *D21H 27/00* | (2006.01) |

(52) U.S. Cl.
CPC ..... *A24D 1/02* (2013.01); *A24C 5/01* (2020.01); *D21H 19/34* (2013.01); *D21H 27/00* (2013.01)

(58) Field of Classification Search
CPC ..... A24D 1/02
See application file for complete search history.

(56) References Cited

U.S. PATENT DOCUMENTS

| | | | | |
|---|---|---|---|---|
| 2,916,039 | A * | 12/1959 | Muller | A24D 3/0204 493/47 |
| 3,805,800 | A * | 4/1974 | Summers | A24D 1/027 131/336 |
| 4,984,589 | A | 1/1991 | Riedesser | |
| 5,143,098 | A * | 9/1992 | Rogers | A24D 1/02 131/365 |
| 5,709,228 | A | 1/1998 | Cohen et al. | |
| 9,491,970 | B2 | 11/2016 | Shinozaki et al. | |
| 2004/0065423 | A1 | 4/2004 | Swerin et al. | |
| 2005/0211259 | A1* | 9/2005 | Gedevanishvili | B82Y 30/00 131/365 |
| 2014/0238425 | A1 | 8/2014 | Kaljura et al. | |
| 2016/0192699 | A1 | 7/2016 | Martha et al. | |
| 2016/0198761 | A1* | 7/2016 | Volgger | D21H 17/67 131/365 |
| 2018/0160725 | A1* | 6/2018 | Buhl | A24C 5/46 |

FOREIGN PATENT DOCUMENTS

| | | | |
|---|---|---|---|
| CA | 2004102 | A1 | 5/1990 |
| CA | 2238756 | | 6/1997 |
| EP | 0 407 022 | B1 | 1/1991 |
| EP | 1 098 036 | A1 | 5/2001 |
| EP | 2 644 043 | A1 | 10/2013 |
| EP | 3 072 404 | A1 | 9/2016 |
| JP | 2014-521360 | A | 8/2014 |
| JP | 2015-156806 | A | 9/2015 |
| JP | 2016-523565 | A | 8/2016 |
| JP | 2016-524904 | A | 8/2016 |
| RU | 2 560 327 | C1 | 8/2015 |
| WO | WO 2007/139726 | A1 | 12/2007 |
| WO | 2009/109433 | A1 | 9/2009 |
| WO | WO 2013/045911 | A1 | 4/2013 |
| WO | 2015/007401 | A1 | 1/2015 |

OTHER PUBLICATIONS

Japan Patent Office, Notice of Reasons for Refusal, Application No. 2020-545624, dated Jan. 6, 2023, 4 pages.

International Searching Authority/EP, International Search Report and Written Opinion of the International Searching Authority, Application No. PCT/EP2019/054262, mailed Jun. 24, 2019, *with English translation of the International Search Report*, 15 pages.

* cited by examiner

*Primary Examiner* — Eric Yaary
(74) *Attorney, Agent, or Firm* — Barclay Damon LLP

(57) ABSTRACT

Disclosed herein is an aerosol-generating article comprising an aerosol-generating material, which is heated during intended use to release an aerosol, but is not burnt, and a wrapping material. Therein, the wrapping material has a thickness of at least 50 μm and at most 350 μm, a basis weight of at least 50 g/m$^2$ and at most 200 g/m$^2$, a specific density of at least 500 kg/m$^3$ and at most 1300 kg/m$^3$, and a bending stiffness of at least 0.15 Nmm and at most 1.50 Nmm. The wrapping material further comprises at least two layers, wherein the layers are connected to each other and wherein one layer is a paper layer, which has a thickness of at least 40 μm and at most 70 μm, a basis weight of at least 50 g/m$^2$ and at most 80 g/m$^2$, and a density of at least 700 kg/m$^3$ and at most 1300 kg/m$^3$, and a specific density that is higher than the specific density of any of the other layers of the wrapping material.

30 Claims, No Drawings

AEROSOL-GENERATING ARTICLE HAVING RIGID ENVELOPING MATERIAL

CROSS-REFERENCE TO RELATED APPLICATIONS

This application is the national phase entry of International Patent Application No. PCT/EP2019/054262 filed on Feb. 21, 2019, and claims the benefit of German Patent Application No. 10 2018 104 823.8 filed Mar. 2, 2018, the disclosures of which are incorporated herein by reference in their entirety.

FIELD OF THE INVENTION

The invention relates to an aerosol-generating article, in which the aerosol-generating material is heated to release an aerosol, but the aerosol-generating material is not burnt. The aerosol-generating article comprises a wrapping material, which is in particular intended for the filter part of the aerosol-generating article. The wrapping material has a particularly high bending stiffness and can be perforated easily by application of a laser. In particular, the wrapping material of the aerosol-generating article according to the invention comprises at least two paper layers connected to each other, which have different specific densities. The invention also relates to a process for manufacturing the respective wrapping material and a corresponding wrapping material.

BACKGROUND AND PRIOR ART

In the prior art, aerosol-generating articles are known which contain an aerosol-generating material and a material which wraps the aerosol-generating material and thus forms a typically cylindrical rod. In this regard, the aerosol-generating material is a material which releases an aerosol upon heating, wherein the aerosol-generating material is only heated but not burnt. In many cases, the aerosol-generating article also comprises a filter, which can filter components of the aerosol and is wrapped with a wrapping material as well as a tipping paper which connects the filter and the rod to each other.

It is common for aerosol-generating articles with filters for there to be a perforation located in the area of the filter. During the intended use, this perforation allows an airflow into the aerosol-generating article, which dilutes the aerosol flowing in the aerosol-generating article. This perforation essentially determines how much aerosol the consumer takes up during the use of the aerosol-generating article. In many cases, the perforation is realized in the form of holes, which are arranged in a circumferential direction around the aerosol-generating article. On the aerosol-generating article, these holes are most often produced by perforation with laser radiation.

For aerosol-generating articles of the aforementioned kind, the filter is often a cylindrical rod of filter fibers, which is wrapped by the filter wrapping paper and the tipping paper. The bending stiffness of the wrapping material is of particular importance for aerosol-generating articles, because these articles are often inserted into a heating device during use to heat the aerosol-generating material. After use of the aerosol-generating article, it is removed from the heating device. Due to the heating of the aerosol-generating article in the heating device, it can adhere to the heating device and a comparatively larger force is needed to remove it from the heating device. In this regard, higher bending loads and corresponding deformations occur both in the area of the filter part usually sticking out of the heating device as well as in the area of the rod of aerosol-generating material inside the heating device. At times, the aerosol-generating article located in the heating device breaks or is deformed such that parts of it remain in the heating device and have to be removed with some effort or prevent the insertion of the aerosol-generating article during the next use. A wrapping material with a high bending stiffness allows the deformation to be limited and essentially prevents such problems. Apart from this special requirement, a high stiffness of the filter part is generally desired, because this counts as a sign of high quality in the consumer's perception.

However, practice has shown that the perforation of stiff wrapping materials with the commonly used laser radiation is difficult. This means that either lower processing speeds or higher laser power is necessary to ensure that stiff papers can also be perforated.

SUMMARY OF THE INVENTION

It is the objective of the invention to provide a wrapping material for an aerosol-generating article, which has a comparatively high stiffness and which can also be perforated easily with laser radiation. This objective is achieved by an aerosol-generating article according to claim 1, a process for manufacturing a suitable wrapping material according to claim 27 and a wrapping material according to claim 29. Further advantageous embodiments are provided in the dependent claims.

The inventors have found that the objective can be achieved with a wrapping material, which has a thickness of at least 50 μm and at most 350 μm, a basis weight of at least 50 g/m$^2$ and at most 200 g/m$^2$, a specific density of at least 500 kg/m$^3$ and at most 1300 kg/m$^3$ and a bending stiffness of at least 0.15 Nmm and at most 1.50 Nmm. According to the invention, the wrapping material comprises at least two layers, wherein the layers are connected to each other and wherein at least one layer is a paper layer. This paper layer has a thickness of at least 40 μm and at most 70 μm, a basis weight of at least 50 g/m$^2$ and at most 80 g/m$^2$ and a density of at least 700 kg/m$^3$ and at most 1300 kg/m$^3$ and has a higher specific density than any other of the remaining layers of the wrapping material.

In this regard "connected to each other" means that there is a connection between each layer of the wrapping material with the layer located above and below such that the stresses caused by bending of the paper can be transferred from one layer to the neighboring layers so that with respect to bending, the wrapping material behaves like a composite and not like several loose sheets lying on top of each other.

The invention is based on the following considerations. The bending stiffness $S_b$ (N·mm) of a homogeneous wrapping material can be described in good approximation by the equation $$S_b = \frac{Q \cdot \rho \cdot d^3}{12}$$

wherein Q is the specific modulus of elasticity (N·mm·kg$^{-1}$), ρ the density (kg·mm$^{-3}$) and d the thickness of the wrapping material (mm). Assuming a constant specific modulus of elasticity Q the bending stiffness $S_b$ can be increased by increasing the density p or the thickness d. In particular, an increase of the thickness, even if the density decreases to the same extent at constant basis weight, increases the bending stiffness.

An increase in the thickness of the wrapping material, however, is limited if it is to be perforated by a laser afterwards. The lasers typically used in such applications generate laser radiation that has a spatially small area of maximum energy density, so that for a thick wrapping material, a considerable part of the wrapping material is located outside the area of maximum energy density and the wrapping material therefore cannot be perforated at the desired speed. According to the invention, the thickness of the wrapping material should thus be below 350 μm.

On the other hand, the density cannot be arbitrarily increased because too dense a wrapping material also cannot be perforated by the laser at high speed. In this regard it should be noted that halving the thickness requires an increase in the density by a factor of 8, if the bending stiffness is to remain the same. For this reason, it is understandable that in practice, stiff wrapping materials that require a high density, a high thickness or both, are indeed difficult to perforate.

The inventors, however, have found that an essentially more advantageous trade-off between stiffness and suitability for perforation can be achieved if the wrapping material has a non-homogeneous distribution of density.

Specifically, the wrapping material according to the invention should be at least 50 μm thick and have a basis weight of at least 50 $g/m^2$ and at most 200 $g/m^2$, so that it has good mechanical strength. The density of the wrapping material as a whole should be at least 500 $kg/m^3$ and at most 1300 $kg/m^3$, so that it can be easily perforated over its entire thickness. The bending stiffness of the wrapping material according to the invention should be at least 0.15 Nmm, which means a substantial increase compared to conventional wrapping materials for aerosol-generating articles and is very well suited for wrapping filters for aerosol-generating articles.

On the other hand, the bending stiffness of the wrapping material should not be too high. During manufacture of the aerosol-generating article, the wrapping material is typically wrapped around the aerosol-generating article and is glued to itself or to the aerosol-generating article. If the restoring forces due to the high bending stiffness are too high, the glued joint re-opens before it has achieved a sufficient strength. The bending stiffness of the wrapping material according to the invention should thus be at most 1.50 Nmm.

According to the invention, the wrapping material should comprise at least two layers, wherein the layers are connected to each other. An essential aspect of the invention is that one of these layers is a paper layer and has a density that is higher than the density of the remaining layers. By means of this non-homogeneous distribution of density over the cross section of the wrapping material, an efficient perforation by laser is possible, ensuring that this dense but comparably thin layer is exactly in the area of maximum energy density of the laser radiation, while the remaining layers, which have lower densities, are located in areas of lower energy density of the laser radiation. By means of this inventive distribution of the density over the cross-section of the wrapping material, the density is adapted to the spatial distribution of the energy density of the laser radiation and an efficient and fast perforation of the wrapping material is possible.

Said paper layer of the wrapping material according to the invention should therefore have a thickness of at least 40 μm and at most 70 μm, a basis weight of at least 50 $g/m^2$ and at most 80 $g/m^2$ and a thickness of at least 700 $kg/m^3$ and at most 1300 $kg/m^3$.

The basis weight of the wrapping material and of the layers of the wrapping material can be determined in accordance with ISO 536:2012. The thickness, as well as the specific volume and thus the density of the wrapping material and of the layers of the wrapping material, can be determined in accordance with ISO 534:2011.

The bending stiffness of the wrapping material and of the layers of the wrapping material can be determined in accordance with TAPPI T556. In this measurement method, a strip of material with known length and width is clamped and touches a force sensor at a defined distance from the clamping position. In this regard, clamping is such that gravity is orthogonal to the plane of bending and thus has no influence on bending. Next, the clamp is turned by a defined angle, typically 15°, so that the strip of material bends and exerts a force on the force sensor. This force is recorded and the bending stiffness is calculated from it. For an asymmetric structure of the wrapping material, as may occur in the invention, the bending measurement is carried out in both directions and is determined by averaging the bending stiffness.

The bending stiffness can also depend on the direction in which the strip of material is taken from the wrapping material. Unless something different is specified, the values for the bending stiffness are independent of this direction. This means, for example, that the bending stiffness is within a specified interval if it is within this interval in at least one direction.

Typical wrapping materials for aerosol-generating articles not according to the invention have a bending stiffness of 0.01 Nmm to 0.10 Nmm.

As described above, the thickness of the wrapping material according to the invention is at least 50 μm and preferably at least 60 μm. The thickness is at most 350 μm, preferably at most 200 μm and particularly preferably at most 150 μm. A low thickness means a low bending stiffness and tensile strength, while a higher thickness at the same basis weight means that the wrapping material can be perforated more easily with laser radiation. The preferred intervals thus allow a particularly advantageous combination of these contradicting requirements.

The basis weight of the wrapping material is essential for its tensile strength. The wrapping material should have a basis weight of at least 50 $g/m^2$, preferably at least 55 $g/m^2$ and particularly preferably at least 60 $g/m^2$. The basis weight should be at most 200 $g/m^2$, preferably at most 130 $g/m^2$ and particularly preferably at most 120 $g/m^2$.

The density of the wrapping material is of essential importance for how much energy is required for the laser radiation to perforate the wrapping material, and it has a considerable influence on the bending stiffness. Thus, the wrapping material should have density of at least 500 $kg/m^3$, preferably at least 600 $kg/m^3$ and particularly preferably at least 700 $kg/m^2$. The density of the wrapping material should be at most 1300 $kg/m^2$, preferably at most 1250 $kg/m^2$ and particularly preferably at most 1200 $kg/m^3$. Here again, the preferred intervals offer an advantageous trade-off between high bending stiffness and good perforation properties.

The bending stiffness of the wrapping material should be at least 0.15 Nmm, preferably at least 0.25 Nmm and particularly preferably at least 0.27 Nmm. In this regard it is ensured that an aerosol-generating article manufactured from the wrapping material according to the invention has such a high stability against mechanical deformation that it is clearly perceptible to the consumer. As a high bending stiffness also means a high restoring force during manufacture of the aerosol-generating article from the wrapping material according to the invention, the bending stiffness should be at most 1.50 Nmm, preferably at most 1.25 Nmm and particularly preferably at most 1.00 Nmm. The preferred intervals in this regard allow a particularly high bending stiffness with trouble-free processing of the wrapping material.

The wrapping material consists of at least two layers that are connected to each other. In a preferred embodiment, the connection between the layers of the wrapping material is carried out in an interlocking manner. An interlocking connection can be produced, for example, by knurling or by mechanical perforation of the layers of the wrapping material stacked upon each other. In this regard, the perforation device bends the edges of the perforation hole of one layer into the layer located below, so that by selecting a sufficient number of perforation holes, a mechanical connection can be produced which is sufficient to transfer bending stresses. Knurling works in a similar manner. An essential advantage of this kind of connection is that no adhesive is needed, and thus the density of the wrapping material is not increased. On the other hand, the tensile strength of the wrapping material is reduced.

In a further preferred embodiment, the layers of the wrapping material are glued to each other. In a variation of this preferred embodiment, all glued connections are carried out over the entire surface. This variation is preferred if as high as possible a bending stiffness is to be achieved. In a further variation of this preferred embodiment, at least one glued connection between two layers of the wrapping material is not made over the entire surface.

Preferably, the at least one glued connection that is not made over the entire surface is made such that adhesive is applied to at least 10%, preferably at least 20% and particularly preferably at least $_4$0% of the area of a layer of the wrapping material. By this means, a good mechanical connection for transferring bending stresses between the layers of the wrapping material can be achieved. On the other hand, the application of adhesive also means an increase in density, so that the adhesive is preferably applied to at most 90%, particularly preferably to at most 70% and more particularly preferably to at most 60% of the area of a layer of the wrapping material.

In addition, preferred intervals can be defined for the amount of adhesive that combine an increased bending stiffness with a low density particularly well. Preferably, the applied amount of adhesive is thus at least 2 g/m$^2$, particularly preferably at least 4 g/m$^2$ and more particularly preferably at least 5 g/m$^2$. The applied amount of adhesive is preferably at most 12 g/m$^2$, particularly preferably at most 10 g/m$^2$ and more particularly preferably at most 9 g/m$^2$. The applied amount in g/m$^2$ in this regard is the amount of adhesive that remains on the paper after drying of the adhesive, with respect to the area to which adhesive has in fact been applied.

If at least one glued connection of the layers of the wrapping material according to the invention is not carried out over the entire surface, particularly preferably, the adhesive in this at least one glued connection is applied in form of a pattern that essentially extends in the direction of the expected tensile and compressive stresses due to the bending load. In particular, the adhesive can be applied in form of a pattern of a plurality of glued spots the mean extent of which is larger in the direction that corresponds to the direction of the expected tensile and compressive stresses due to the bending load than in the direction orthogonal thereto. Because of the orientation along the direction of loading, further adhesive can be saved and the density of the wrapping material does not increase so much, without substantially reducing the bending stiffness.

For an essentially cylindrical aerosol-generating article that is wrapped by the wrapping material according to the invention, the expected load is primarily a compression, i.e. a bending load in the circumferential direction. In this case, the glued connection can be carried out as a pattern of lines in the circumferential direction of the aerosol-generating article so that the wrapping material has a particularly high bending stiffness in this direction. Generally, at the time of manufacturing the wrapping material, it is already known which direction on the wrapping material will later correspond to the circumferential direction of an aerosol-generating article manufactured therefrom.

If the wrapping material comprises three of more layers, so that two or more glued connections are required, gluing can be carried out such that the application patterns of the adhesive extend in different directions in each glued connection. More particularly preferably, the directions of two such patterns are essentially orthogonal to each other.

The adhesive and the process for gluing the layers of the wrapping material can be selected by the skilled person in accordance with the prior art.

Gluing between at least two layers can preferably be use, if the wrapping material is to additionally form a good barrier against the penetration of water or oil. Some filters for aerosol-generating articles contain at least one capsule inside, which contains at least one aromatic substance and which can be crushed by the consumer by pressure with the fingers during use to release the at least one aromatic substance. The aromatic substance or the respective solvent, such as water or oil, can penetrate the wrapping material and cause stains on the visible outer surface of the aerosol-generating article, which are not desirable.

Thus, insofar as at least two layers of the wrapping material are glued to each other, the wrapping material can preferably be designed such that it has a resistance against the penetration of oil and a KIT level, measured in accordance with TAPPI T559 cm-02, of at least 4, particularly preferably of at least 6 and more particularly preferably of at least 10. Such a resistance against the penetration of oils can be controlled, for example, by the amount of adhesive, the type of adhesive and in particular the smoothness of the layers of the wrapping material to be glued to each other. A high smoothness in general leads to the formation of a homogeneous, closed layer of adhesive and thus to a higher resistance against the penetration of oils. The adhesive can preferably contain filler materials or other materials that control the barrier effect.

Insofar as at least two layers of the wrapping material are glued to each other, the wrapping material is preferably designed such that it has a resistance against the absorption of water. For the measurement of the absorption of water, the Cobb$_{60}$-value, measured in accordance with ISO 535:2014, can be used, which describes the amount of water in g/m$^2$ absorbed in a defined time. As the ability to absorb water will be also substantially determined by the basis weight of the wrapping material, it makes sense to refer the Cobb$_{60}$-value to the basis weight in g/m$^2$ and in this regard arrive at a dimensionless ratio which describes the water absorption essentially independently of the basis weight. A good resistance against the absorption of water can also be of importance for the wrapping material, to achieve a good adhesion of the wrapping material to components of the aerosol-generating article at high production speeds. For the wrapping material according to the invention, the ratio of the $Cobb_{60}$-value in accordance with ISO 535:2014 in $g/m^2$ divided by the basis weight of the wrapping material in $g/m^2$ is at most 0.80, particularly preferably 0.50 and more particularly preferably at most 0.20.

The wrapping material according to the invention comprises at least one layer that is a paper layer and has a higher specific density than any other of the remaining layers of the wrapping material.

Said paper layer has a thickness of at least 40 μm, preferably of at least 45 μm and particularly preferably of at least 50 μm. The thickness of said paper layer is at most 70 μm, preferably at most 65 μm and particularly preferably at most 60 μm. Said paper layer furthermore has a basis weight of at least 50 $g/m^2$, preferably at least 55 $g/m^2$ and particularly preferably at least 60 $g/m^2$. Said paper layer has a basis weight of at most 80 $g/m^2$, particularly preferably at most 75 $g/m^2$ and particularly preferably at most 70 $g/m^2$.

For the bending stiffness to be in an advantageous range, said paper layer has a density of at least 700 $kg/m^3$, particularly preferably at least 750 $kg/m^3$ and at most 1300 $kg/m^3$, particularly preferably at most 1250 $kg/m^3$. To achieve such a high density and also a low thickness, the paper layer can be calendered.

By this combination of parameters of thickness, basis weight and density according to the invention, a good bending stiffness can be achieved. Furthermore, said paper layer is dense, but sufficiently thin to be perforated in a trouble-free manner by laser light as a component in the wrapping material.

Said paper layer furthermore contributes substantially to the bending stiffness of the wrapping material and thus by itself already has a high bending stiffness. In particular, the bending stiffness of this paper layer is preferably at least 0.06 Nmm, particularly preferably at least 0.07 Nmm and preferably at most 0.20 Nmm, particularly preferably at most 0.18 Nmm.

Said paper layer comprises pulp. The pulp can be sourced from deciduous wood, coniferous wood or also from other plants. The pulp can, for example, be produced by chemical or mechanical processes or combinations thereof known in the prior art, wherein mechanically produced pulp is preferably used because of its higher lignin content and the higher bending stiffness resulting therefrom. On the other hand, because of the better bonds between the fibers, chemically produced pulp can preferably be used if the paper layer is to be calendered.

Said paper layer can comprise at least one filler material, wherein the at least one filler material is formed by particles and preferably, the particles extend in at least one spatial direction substantially more than in at least one direction orthogonal thereto. This can mean that the particles are preferably acicular or flaky. This particle shape contributes to an increase in bending stiffness of said paper layer. Particularly preferred filler materials are acicular limestone, flaky limestone, kaolin, talc and mixtures thereof.

The skilled person can select further additives and components of said paper layer in accordance with the prior art, wherein preferably, additives can be used that increase the strength of the paper layer such as, for example, starch, starch derivatives, cellulose derivatives, polyvinyl alcohol, guar, guar derivatives or latex and mixtures thereof. For the type and amount of such additives, care has to be taken that the paper layer does not become too brittle, so that its energy absorption is too low and it cannot be deformed sufficiently without breaking during manufacture of the aerosol-generating article from the wrapping material manufactured therefrom.

With respect to further layers in the wrapping material according to the invention, web-shaped materials, for example, paper or plastic film can be selected, provided that the requirements regarding thickness, basis weight, density and bending stiffness of the wrapping material are fulfilled.

If a further layer of the wrapping material is formed as a paper layer, this layer comprises pulp and preferably a part of the pulp is pulp from hemp, flax, sisal, jute or abacá. These pulps allow a paper with a particularly low density to be produced. Preferably, such a further paper layer contains no or little filler material, so that the content of filler material is less than 10% by weight with respect to the weight of this paper layer, as the filler material for such papers primarily increases the density without appreciably contributing to bending stiffness.

Preferably, such a further paper layer is then produced on an inclined-wire machine which is known in the art.

Generally, regarding the components of wrapping materials for aerosol-generating articles, legal requirements have to be observed.

When selecting the further layers and in particular the number of further layers, it should also be noted that the potentially required adhesive between the layers increases the basis weight and the density and thus could complicate compliance with the requirements for the wrapping material according to the invention. For this reason, which primarily concerns layers glued to each other, but also independently thereof for reasons of efficiency during manufacturing of the layers and of the wrapping material, it is preferable to select the number of layers to be as low as possible.

In a preferred embodiment, the wrapping material thus comprises exactly two or three layers, wherein all layers are formed by paper layers.

With respect to said one paper layer, i.e. that with a higher density than the other layers, and with respect to the further layers that are formed by paper layers in this preferred embodiment, the same restrictions and requirements apply as have been described above.

Insofar as the wrapping material according to the invention comprises exactly three layers, which are all formed as paper layers, the middle paper layer can be formed such that its density is lower than the density of the two outer paper layers. In this manner, under the given restrictions, a particularly high bending stiffness is achieved, but the thickness of the middle paper layer must not be too high so that the wrapping material can still be perforated at high speed. Particularly preferably, the thickness of the middle paper layer in this case is at least 30 μm and at most 80 μm.

In a further embodiment of the wrapping material according to the invention wherein the wrapping material comprises exactly three layers, which are all formed by paper layers, said paper layer, the density of which is higher than that of any further layers, can form the middle paper layer in the wrapping material. In this manner under the given restrictions, a particularly good perforation capability can be achieved. Because, however, the bending stiffness of the wrapping material is also high, a greater thickness of both outer paper layers has to be selected. Particularly preferably, the thickness of each of the two outer paper layers is at least 40 μm and at most 100 μm.

Wrapping materials according to the invention that comprise exactly two or three layers, wherein all layers are paper layers, can preferably be produced by a process in which several head boxes are provided on a conventional paper machine, from which different suspensions of pulp and filler flow onto the wire of the paper machine, and thereby, a composite of several layers is already formed on the wire which afterwards forms the wrapping material according to the invention. In this manner, gluing of the layers is not needed, whereupon material and production steps are saved and the paper layers can be designed even better with respect to bending stiffness and suitability for perforation. Specifically, a first pulp-containing suspension can be released from a first head box onto the wire of a paper machine, in order to form a first paper layer, and a second pulp-containing suspension can be released from a second head box onto the first paper layer lying on the wire of the paper machine to form a second paper layer which forms a composite with the first paper layer. Optionally, a third pulp-containing suspension can be released from a third head box onto the second paper layer in order to form a third paper layer, which forms a composite with the second paper layer.

An aerosol-generating article according to the invention comprises a filter and a rod, which contains an aerosol-generating material, wherein the filter is wrapped with the wrapping material according to the invention.

DESCRIPTION OF PREFERRED EMBODIMENT

Some preferred embodiments of wrapping materials according to the invention will be described below.

In all embodiments, the wrapping material consists of two paper layers, which are glued to each other, wherein a first paper layer, designated as paper layer A, has a substantially higher density than the other paper layer.

In all embodiments, paper layer A was a calendered paper consisting of a mixture of 80% by weight pulp from coniferous wood and 20% by weight pulp from deciduous wood. The paper was coated with 2 g/m$^2$ polyvinyl alcohol. The basis weight of the paper was 62.7 g/m$^2$, the thickness 50.4 μm and the density 1244 kg/m$^3$. The paper had a bending stiffness of 0.100 Nmm.

This paper was glued as paper layer A over its entire surface to two different papers, in order to obtain two different wrapping materials according to the invention.

Example 1

The aforementioned paper layer A was connected to a paper with a basis weight of 30.9 g/m$^2$, a thickness of 48.8 μm, a density of 633 kg/m$^3$ and a bending stiffness of 0.022 Nmm to form a wrapping material according to the invention. The paper did not contain filler material and the pulp was a mixture of 25% by weight pulp from coniferous wood (softwood pulp) and 75% by weight pulp from deciduous wood (hardwood pulp), wherein the percentages refer to the weight of the pulp. The paper layers were connected by gluing the entire surface, wherein 11.3 g/m$^2$ of adhesive was applied. This value was determined after drying the adhesive, from the difference in the basis weights before and after gluing.

The wrapping material produced thereby had a basis weight of 104.2 g/m$^2$, a thickness of 100.6 μm and a density of 1035 kg/m$^2$. The bending stiffness of the wrapping material was measured and a value of 0.270 Nmm was found. In addition, the KIT level was determined in accordance with TAPPI T559 cm-02 and a value of 11 was found.

This bending stiffness is considerably higher than the value for conventional wrapping materials for aerosol-generating articles. Filter rods wrapped with this wrapping material were manufactured from the wrapping material without any problems in accordance with processes known in the prior art. In a further process known in the prior art, the filter rods and further components were used to manufacture aerosol-generating articles, which were perforated in the circumferential direction in the center of the filter by a $CO_2$ laser. This was possible without any problems up to a production speed of 10000 aerosol-generating articles per minute, so that this exemplary wrapping material combines high bending stiffness with good perforation capability.

Example 2

The aforementioned paper layer A was connected to a paper with a basis weight of 22.5 g/m$^2$, a thickness of 50.8 μm, a density of 443 kg/m$^2$ and a bending stiffness of 0.018 Nmm to form a wrapping material according to the invention. The paper did not contain filler material and consisted exclusively of pulp from coniferous wood (softwood pulp) and pulp from sisal. The paper layers were connected by gluing the entire surface, wherein 7.2 g/m$^2$ of adhesive were applied. This value was determined after drying the adhesive, from the difference in the basis weights before and after gluing.

The wrapping material produced thereby had a basis weight of 91.7 g/m$^2$, a thickness of 99.4 μm and a density of 922 kg/m$^2$. The bending stiffness of the wrapping material was measured and a value of 0.286 Nmm was found. In addition, the KIT level was determined in accordance with TAPPI T559 cm-02 and a value of ii was found.

This bending stiffness is considerably higher than the value for conventional wrapping materials for aerosol-generating articles. Filter rods wrapped with this wrapping material were manufactured from the wrapping material without any problems in accordance with processes known in the prior art. In a further process known in the prior art the filter rods and further components were used to manufacture aerosol-generating articles, which were perforated in the circumferential direction in the center of the filter by a $CO_2$-laser. This was possible without any problems up to a production speed of 10000 aerosol-generating articles per minute, so that this exemplary wrapping material combines a high bending stiffness with good perforation capability.

The invention claimed is:

1. Aerosol-generating article comprising an aerosol-generating material, which is heated during intended use to release an aerosol, but is not burnt, and a wrapping material, wherein the wrapping material has a thickness of at least 50 μm and at most 350 μm, a basis weight of at least 50 g/m$^2$ and at most 200 g/m$^2$, a specific density of at least 500 kg/m$^3$ and at most 1300 kg/m$^3$, and a bending stiffness of at least 0.15 Nmm and at most 1.50 Nmm, wherein the wrapping material comprises at least two layers, wherein the layers are connected to each other and wherein one layer is a paper layer, which has a thickness of at least 40 μm and at most 70 μm, a basis weight of at least 50 g/m$^2$ and at most 80 g/m$^2$, and a density of at least 700 kg/m$^3$ and at most 1300 kg/m$^3$, and a specific density that is higher than the specific density of any of the other layers of the wrapping material.

2. Aerosol-generating article according to claim 1, wherein the thickness of the wrapping material is at least 60 μm and at most 200 μm.

3. Aerosol-generating article according to claim 1, wherein the basis weight of the wrapping material is at least 60 g/m$^2$ and at most 120 g/m$^2$.

4. Aerosol-generating article according to claim 1, wherein the density of the wrapping material is at least 700 kg/m$^3$ and at most 1200 kg/m$^3$.

5. Aerosol-generating article according to claim 1, wherein the bending stiffness of the wrapping material is at least 0.25 Nmm and at most 1.25 Nmm.

6. Aerosol-generating article according to claim 1, wherein the connection between at least two layers is in an interlocking manner, wherein the interlocking connection is produced by knurling or by mechanically perforating the layers of wrapping material stacked upon each other.

7. Aerosol-generating article according to claim 1, wherein at least two layers of the wrapping material are glued to each other.

8. Aerosol-generating article according to claim 7, wherein the glued connection covers an entire surface.

9. Aerosol-generating article according to claim 7, wherein at least one glued connection between two layers of the wrapping material does not cover the entire surface, wherein the at least one glued connection which does not cover the entire surface is such that adhesive is applied to at least 10% and to at most 90% of the area of one layer of the wrapping material.

10. Aerosol-generating article according to claim 7, wherein amount of adhesive that remains after drying, with respect to the area to which adhesive has in fact been applied, is at least 2 g/m$^2$ and at most 12 g/m$^2$.

11. Aerosol-generating article according to claim 9, wherein the adhesive is applied in at least one glued connection between two layers of the wrapping material in the form of a pattern that is formed by a plurality of glued spots, the average extent of which is higher in one direction that corresponds to the direction of the expected tensile and compressive stresses due to the bending load than in a direction orthogonal thereto.

12. Aerosol-generating article according to claim 11, which has an essentially cylindrical shape and wherein the glued connection is applied in the form of a pattern of lines which extend in a direction that corresponds to the circumferential direction of the aerosol-generating article.

13. Aerosol-generating article according to claim 9, the wrapping material of which comprises three or more layers which are connected by two or more glued connections, wherein two of these two or more glued connections are each formed by a pattern of a plurality of glued spots, the average extent of which in the respective preferred direction being larger than in a direction orthogonal thereto and wherein said preferred directions of these at least two glued connections are different.

14. Aerosol-generating article according to claim 7, the wrapping material of which has a KIT level, measured in accordance with TAPPI T559 cm-02, of at least 4.

15. Aerosol-generating article according to claim 7, the wrapping material of which has a ratio of the Cobb$_{60}$-value in accordance with ISO 535:2014 in g/m$^2$ divided by the basis weight of the wrapping material in g/m$^2$ of at most 0.80.

16. Aerosol-generating article according to claim 1, wherein said paper layer of the wrapping material with the highest specific density has a thickness of at least 45 μm and a thickness of at most 65 μm.

17. Aerosol-generating article according to claim 1, wherein said paper layer of the wrapping material with the highest specific density has a basis weight of at least 55 g/m$^2$ and a basis weight of at most 75 g/m$^2$.

18. Aerosol-generating article according to claim 1, wherein said paper layer of the wrapping material with the highest specific density has a density of at least 1150 kg/m$^3$ and of at most 1250 kg/m$^3$.

19. Aerosol-generating article according to claim 1, wherein the bending stiffness of said paper layer per se of the wrapping material with the highest specific density is at least 0.06 Nmm and at most 0.20 Nmm.

20. Aerosol-generating article according to claim 1, wherein said paper layer of the wrapping material with the highest specific density comprises a filler material, which is formed by particles, the extension of which in at least one spatial direction is on average larger by a factor of at least 2 than in a direction orthogonal thereto, wherein the filler material is formed by acicular limestone, flaky limestone, kaolin, talc or mixtures thereof.

21. Aerosol-generating article according to claim 1, wherein said paper layer of the wrapping material with the highest specific density contains one or more additives selected from the group consisting of starch, starch derivatives, cellulose derivatives, polyvinyl alcohol, guar, guar derivatives and latex.

22. Aerosol-generating article according to claim 1, wherein an at least one further layer of the wrapping material is also formed by paper or by a plastic film.

23. Aerosol-generating article according to claim 22, wherein the at least one further layer is formed by a paper layer, which contains pulp, wherein at least a part of the pulp is formed by pulp from hemp, flax, sisal, jute or abacá.

24. Aerosol-generating article according to claim 1, the wrapping material of which comprises exactly two or three layers, wherein all of the layers are formed by paper layers.

25. Aerosol-generating article according to claim 24, the wrapping material of which comprises exactly three layers, which are all formed by paper layers, wherein the density of the middle paper layer is lower than the density of the two outer paper layers.

26. Aerosol-generating article according to claim 23, the wrapping material of which comprises exactly three layers, which are all formed by paper layers, wherein said paper layer with a density that is higher than that of any further layer forms the middle paper layer in the wrapping material, wherein the thickness of each of the outer paper layers is at least 40 μm and at most 100 μm.

27. Process for the manufacture of a wrapping material for an aerosol-generating article according to claims 1, wherein the wrapping material has a thickness of at least 50 μm and at most 350 μm, a basis weight of at least 50 g/m$^2$ and at most 200 g/m$^2$, a specific density of at least 500 kg/m$^3$ and at most 1300 kg/m$^3$, and a bending stiffness of at least 0.15 Nmm and at most 1.50 Nmm, wherein the wrapping material comprises at least two paper layers, which are connected to each other, including a paper layer the specific density of which is higher than the specific density of each of the other layers of the wrapping material and which has a thickness of at least 40 μm and at most 70 μm, a basis weight of at least 50 g/m$^2$ and at most 80 g/m$^2$, and a density of at least 700 kg/m$^3$ and at most 1300 kg/m$^3$, wherein a first pulp-containing suspension is released from a first head box onto the wire of paper machine to form a first paper layer, and a second pulp-containing suspension is released from a second head box onto the first paper layer lying on the wire of the paper machine to form a second paper layer, which forms a composite with the first paper layer.

28. Process according to claim 27, wherein a third pulp-containing suspension is released from a third head box onto the second suspension to form a third paper layer, which forms a composite with the second paper layer.

29. Wrapping material for aerosol-generating articles that contain an aerosol-generating material, which during intended use is heated to release an aerosol but is not burnt, with a thickness of at least 50 μm and at most 350 μm, a basis weight of at least 50 $g/m^2$ and at most 200 $g/m^2$, a specific density of at least 500 $kg/m^3$ and at most 1300 $kg/m^3$, and a bending stiffness of at least 0.15 Nmm and at most 1.50 Nmm, wherein the wrapping material comprises at least two layers, wherein the layers are connected to each other, and wherein one layer is a paper layer, which has a thickness of at least 40 μm and at most 70 μm, a basis weight of at least 50 $g/m^2$ and at most 80 $g/m^2$, and a density of at least 700 $kg/m^3$ and at most 1300 $kg/m^3$, and a specific density that is higher than the specific density of each of the other layers of the wrapping material.

30. Wrapping material according to claim 29, for use in an aerosol-generating article according to claim 1.

* * * * *